United States Patent [19]

Ross

[11] 4,199,441

[45] Apr. 22, 1980

[54] PLACER MINING SLUICE BOX APPARATUS AND METHOD

[76] Inventor: Lorne M. Ross, Box 275, Dawson City, Yukon, Canada, Y0B 1G0

[21] Appl. No.: 942,426

[22] Filed: Sep. 14, 1978

[30] Foreign Application Priority Data

Jul. 31, 1978 [CA] Canada ..... 308435

[51] Int. Cl.[2] ..... B03B 7/00

[52] U.S. Cl. ..... 209/44; 209/458; 209/498

[58] Field of Search ..... 209/44, 13, 458, 460, 209/485, 498

[56] References Cited

U.S. PATENT DOCUMENTS

| | | | |
|---|---|---|---|
| 525,983 | 9/1894 | Irvin | 209/44 |
| 801,968 | 10/1905 | Clark | 209/44 |
| 849,614 | 4/1907 | Holmes | 209/44 |
| 936,754 | 10/1909 | Barbour | 209/44 |
| 1,216,798 | 2/1917 | Green | 209/44 |
| 1,621,697 | 3/1927 | Warner | 209/12 |
| 2,174,925 | 10/1939 | McKeever | 209/44 |

*Primary Examiner*—Ralph J. Hill
*Attorney, Agent, or Firm*—Moss & Bensette

[57] ABSTRACT

A sluice box is disclosed for use in high volume placer mining operations and a method of placer mining is disclosed, which are particularly useful for the recovery of gold from aggregate material. In operation, aggregate material is loaded into an inlet trough of the sluice box where it is mixed with water to form a slurry. A coarse recovery channel leads from the inlet trough and the sluice box is downwardly inclined, so that the slurry flows through the sluice box. The inlet trough has a punch plate bottom for separating the slurry into a coarse slurry stream which passes on into the coarse recovery channel, and a fine slurry stream which drops through the punch plate. A distribution section located below the punch plate has a generally conical and upwardly inclined floor, and angularly disposed vanes, so that the fine slurry stream is spread transversely and evened to produce a generally uniform cross-sectional flow profile. The fine slurry stream then passes into fine recovery channels located beside the coarse recovery channel. Both the fine and coarse recovery channels have bottom coco mat layers and transverse riffles located thereon for agitating the fine and coarse slurry streams allowing the gold particles to settle and be trapped in the coco matting. The gold particles are trapped quickly without subsequent washing out, thus allowing high volumes of aggregate material to be processed through the sluice box producing higher recovery rates than in the past.

13 Claims, 5 Drawing Figures

PLACER MINING SLUICE BOX APPARATUS AND METHOD

The present invention relates to apparatus and a method for recovering precious metal, such as gold, from aggregate material as in placer mining.

In the past, many different types of devices have been used in placer mining operations for the recovery of gold, or other precious metals, or the like. Whether these devices are called separators, concentrators, collectors, or whatever, they usually depend upon differences in density between the precious metal to be collected and the aggregate material from which it must be separated. However, the aggregate material has a very heterogeneous composition in that it may comprise in varying quantities: fine sand, clay, stones, hematite or magnatite (sometimes referred to as black sands), rocks, and even large boulders. Further, the gold particles themselves may range in size from nuggets down to extremely fine flakes or flour gold. This makes it very difficult to recover the gold, because the gold once separated can be easily re-mobilized and subsequently lost. In addition, where water is used in the separation process, surface tension effects acting on fine gold flakes often act counter to any settling action, thus preventing the fine gold from being trapped and recovered. The result is that the fine flake or flour gold is extremely difficult to separate efficiently from the aggregate material.

In an attempt to deal with the difficulty of recovering the fine gold particles, placer mining apparatus has been designed in an attempt to segregate the coarser aggregate material and separately process the finer aggregate material, so that the fine gold particles can be separated and not subsequently mobilized and lost. An example of such apparatus is shown in U.S. Pat. No. 2,174,925, issued to G. B. McKeever. In the machine shown in this patent, the coarse aggregate material is segregated from the fine material using a shaking screen, and the fine aggregate material is subsequently passed over a filter to trap the gold particles. A difficulty with this type of apparatus is that only relatively small volumes of aggregate material may be handled, and even then, it is not possible to handle all types of aggregate material which may be encountered. For example, it is not uncommon to encounter large boulders or other objects several feet in diameter in the aggregate material. Any machines which have moving screens or filtering elements generally cannot be used with this type of aggregate material. Further, the devices in the past have been complicated, especially if they involve moving parts, and therefore are expensive to operate and maintain.

In the present invention, a high volume method of separating gold particles from aggregate material is provided using a sluice box type apparatus, wherein the extremely fine gold is quickly separated and trapped so that it is not remobilized by subsequently processed aggregate material and lost.

According to one aspect of the invention, there is provided apparatus for use in high volume placer mining operations to separate and recover precious metals, such as gold, from aggregate material. The apparatus comprises a sluice box having an inlet trough and a coarse recovery channel leading therefrom and defining an outlet. A water manifold is adapted to be connected to a supply of water under pressure for washing aggregate material in the inlet trough to form a slurry. The sluice box is adapted to be inclined so that the slurry passes through the sluice box from the inlet to the outlet. The inlet trough has a punch plate bottom located adjacent to the coarse recovery channel. The punch plate bottom defines a plurality of openings for passing fine slurry therethrough and permitting coarse slurry to pass thereover into the coarse recovery channel. A distribution section is located below the punch plate bottom. The distribution section has a transversely and downwardly inclined floor and a plurality of angularly disposed vanes, so that the fine slurry is evened and spread transversely of the sluice box axis. A fine recovery channel is located beside the coarse recovery channel and communicates with the distribution section to receive the evened fine slurry. Also, the coarse and fine recovery channels have bottom coco mat layers, and respective coarse and fine riffles located thereon, so that as the coarse and fine slurries pass over the respective coarse and fine riffles, precious metal settles and is trapped in the coco mat.

According to another aspect of the invention there is provided a method of separating and recovering precious metals from aggregate material in a high volume placer mining operation. The method comprises the steps of introducing aggregate material into a sluice box at a generally steady rate. Water is added to the aggregate material to form a slurry for movement through the sluice box. The slurry is separated into a fine slurry stream and a coarse slurry stream. The fine slurry stream is spread and evened, so that it has a generally uniform cross-sectional flow profile. The fine and coarse slurry streams are agitated by passing same over respective fine and coarse riffles. Also, precious metal that settles out of the agitated fine and coarse slurry streams is trapped by providing coco matting below the riffles to retain the precious metal.

A preferred embodiment of the present invention will now be described by way of example, with reference to the accompanying drawings, in which.

Figure 2:
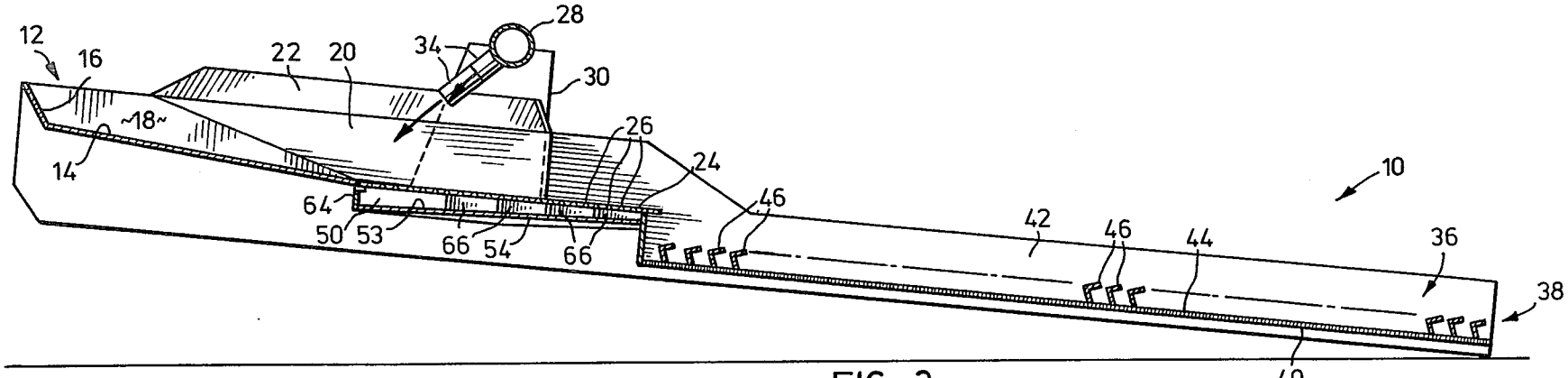
FIG. 2 is a vertical sectional view taken along lines 2—2 of FIG. 1.
Figure 3:
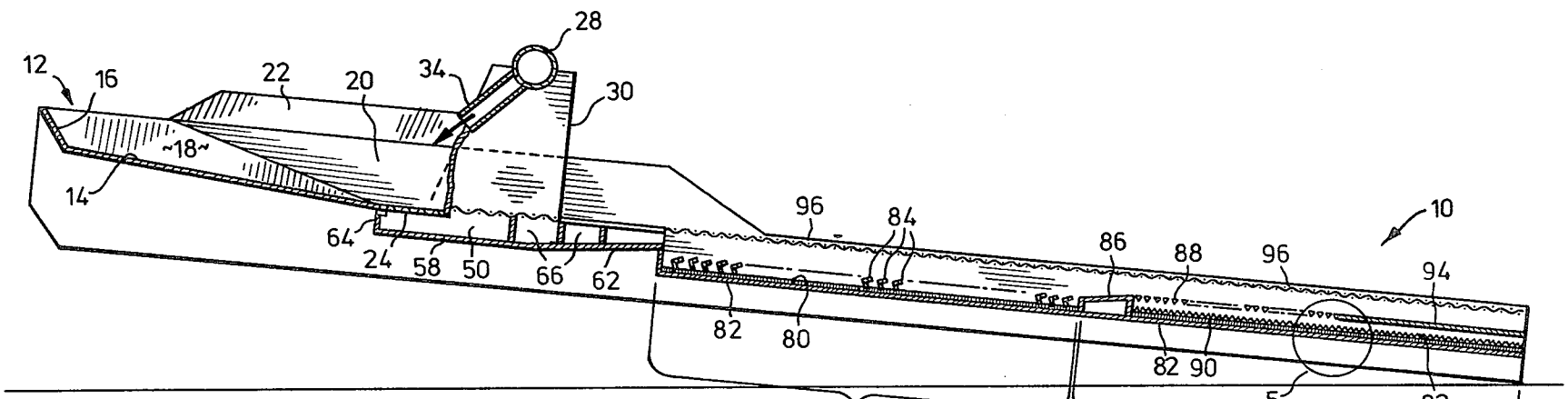
FIG. 3 is a vertical sectional view taken along lines 3—3 of FIG. 1.

Referring to the drawings, a preferred embodiment of a sluice box according to the present invention is generally indicated by reference numeral 10. Sluice box 10 is approximately thirty-six feet in length, sixteen feet in width, and about four and one-half feet in overall height. Sluice box 10 is thus relatively easy to transport and position, as will be described further below. However, for the present purposes, it is sufficient to note that sluice box 10 is downwardly inclined in use, as shown in FIGS. 2 and 3.

Sluice box 10 includes an inlet trough 12 which is defined by a bottom downwardly inclined slick plate 14, a rearwardly and upwardly inclined back wall 16, outwardly and upwardly inclined side walls 18, vertical forward walls 20, and upper outwardly inclined side panels 22. Inlet trough 12 also includes a flat bottom punch plate 24.

Figure 1:
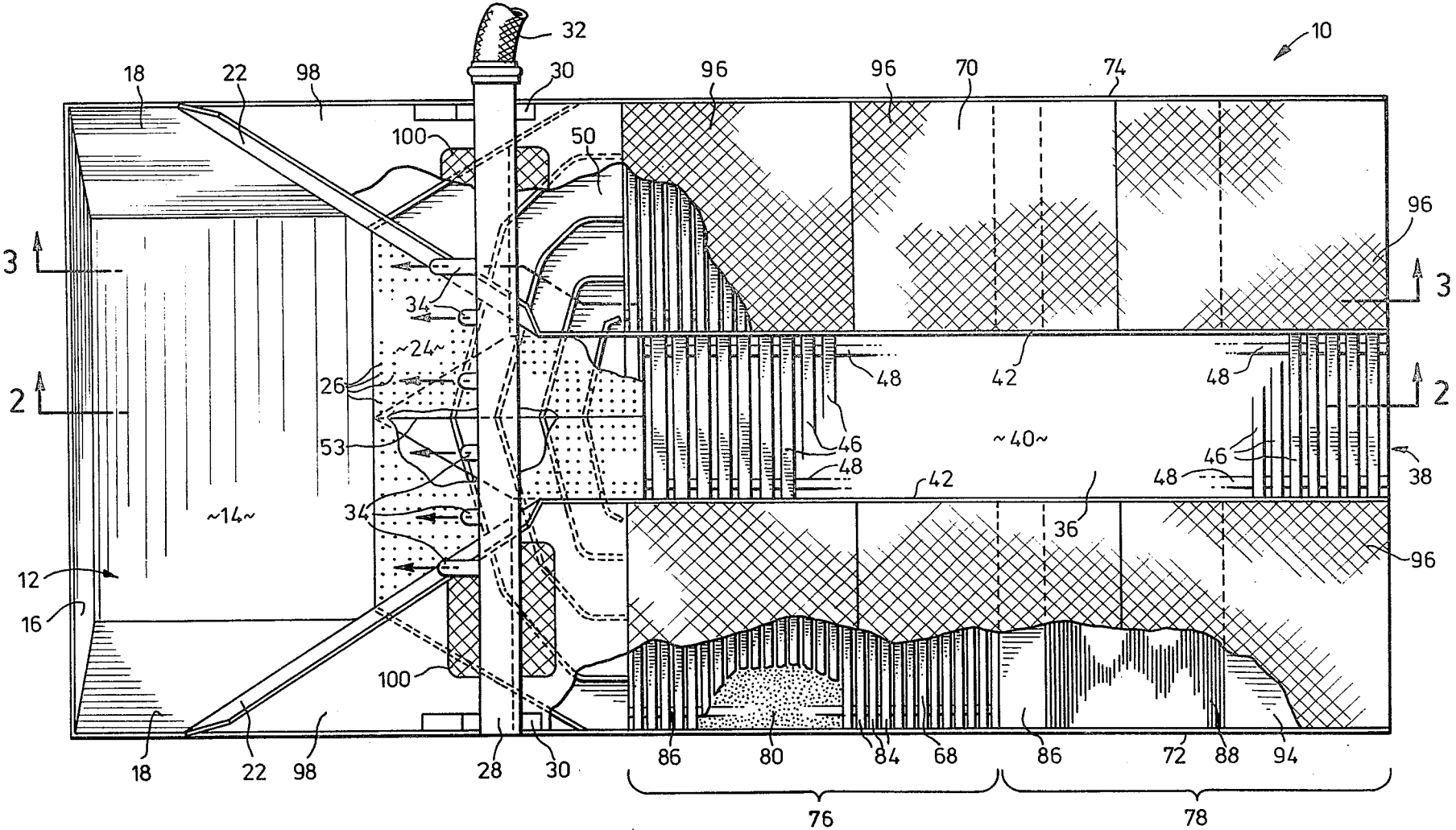
FIG. 1 is a plan view, partly broken away, of a sluice box according to the present invention.

As seen best in FIG. 1, punch plate 24 is generally conical in shape to conform to a narrowing or throat portion of inlet trough 12. Punch plate 24 is typically formed from ¾ inch thick manganese steel plate and is formed in two or more parts to facilitate removal. Punch plate 24 defines a plurality of openings 26 arranged in a regular pattern, with a center to center distance between the openings of approximately one and three-sixteenth inches. Openings 26 are tapered or conical in shape, so that at the upper surface of punch plate 24 the openings are approximately ⅜ inch in diameter, and the openings widen downwardly to about nine-sixteenth inch in diameter at the lower surface.

A water manifold 28 is located above inlet trough 12 and is held in position by supports 30. Manifold 28 is adapted to be connected to a supply of water under pressure, indicated by a portion of flexible pipe 32 in FIG. 1. Manifold 28 is typically a ten inch diameter pipe and has six 4 inch downwardly and rearwardly disposed nozzles 34 communicating therewith to supply water to inlet trough 12. Water manifold 28 supplies approximately 3,500 gallons of water per minute at between 25 and 30 pounds pressure through nozzles 34.

Sluice box 10 also includes a coarse recovery channel 36 leading from inlet trough 12 and defining an outlet 38. Coarse recovery channel 36 has a flat bottom surface 40 and parallel vertical side walls 42. Bottom surface 40 is located approximately fourteen inches below punch plate 24, and coarse recovery channel 36 is approximately twenty feet in length. A coco mat layer 44 is located on bottom surface 40, and transverse coarse riffles 46 are located on the coco mat layer 44. Riffles 46 are formed of steel angle stock members typically having equal two and one-half inch legs. The riffle angle members are parallel and are spaced apart the same distance as the width of the leg of the angle, namely two and one-half inches. The riffle angle members are disposed so that the top or upper legs are slightly above horizontal as seen best in FIG. 2, and are held in position by longitudinal retaining bars 48 to form a unitary structure. In this way, riffles 46 may be removed from coarse recovery channel 36 for access to the coco matting layer 44, so that the latter may in turn be removed and cleaned, as will be described further below.

Figure 4:
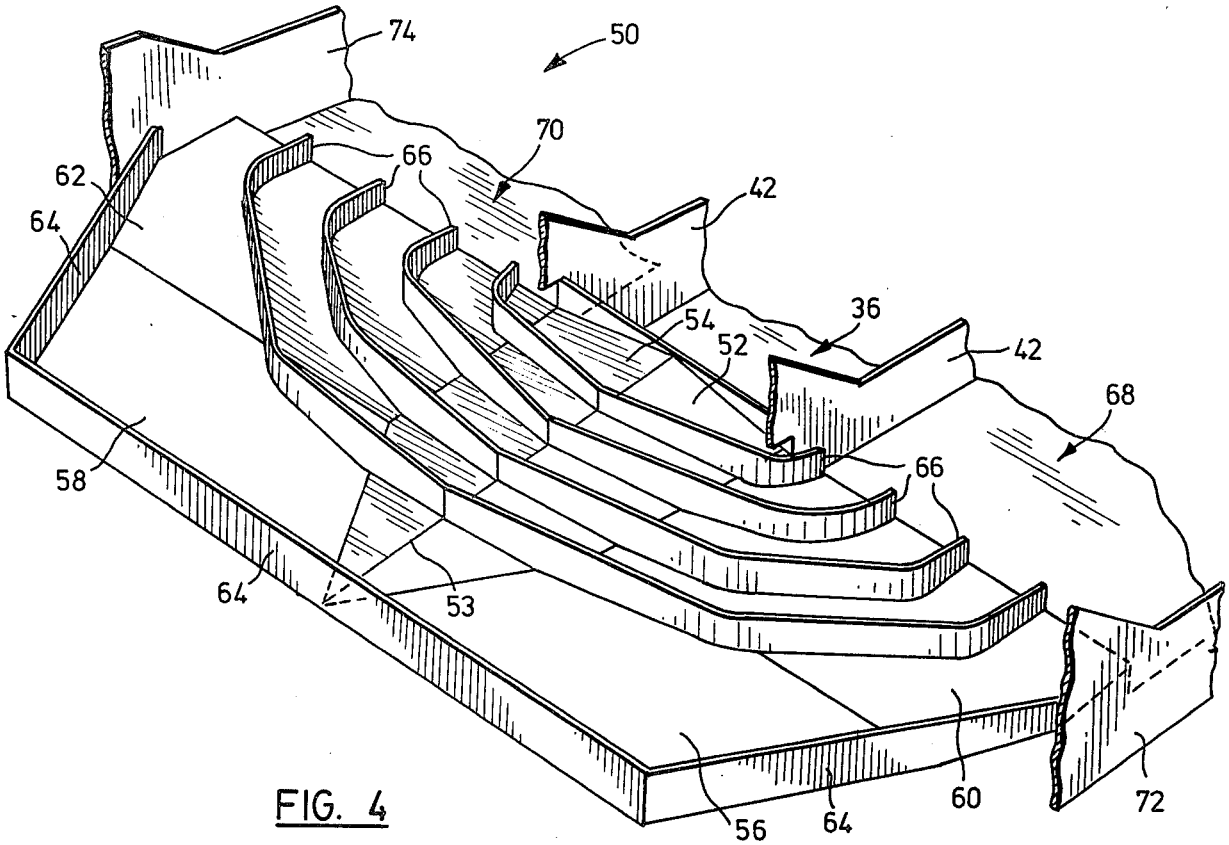
FIG. 4 is an enlarged perspective view of the distribution section of the sluice box of FIG. 1.

Sluice box 10 also includes a distribution section 50, as seen best in FIG. 4, which is located below and to either side of punch plate 24. Distribution section 50 includes a first transversely and downwardly inclined floor portion 52 and a second transversely and downwardly inclined floor portion 54. Inclined floor portions 52, 54 are flat plates and together they form a generally conical floor portion which is upwardly inclined toward the coarse recovery channel 36. The flat inclined floor portions 52, 54 form a central ridge 53 which is approximately six feet long and is inclined at a slope of about one inch per foot. The distribution section floor also includes first and second flat portions 56, 58 and first and second ramps 60, 62 which are inclined upwardly and longitudinally of the sluice box axis. Ramps 60, 62 are approximately three feet in width (measured along the sluice box central longitudinal axis) and are inclined at a slope of about one inch per foot. Peripheral side walls 64 are located rearwardly around the distribution section floor to contain the fine slurry as discussed below. A plurality of angularly disposed vanes 66 are located on the distribution section floor to even and spread the flow of fine slurry, also as described further below. However, it will be appreciated that vanes 66 generally follow the contour of the floor of the distribution section and are forwardly angularly disposed. In fact, the vanes 66 are located on the first and second distribution section floor portions such that the vanes are allochiral (mirrow image) or symmetrical about the central sluice box axis. The vanes are generally parallel and are spaced apart distances ranging from about twelve inches to about twenty inches, the shorter spacing being between the smallest and next largest vanes 66. Further, the parts of the vanes adjacent to the central axis of the sluice box are disposed at an angle to this axis of approximately 75°, the larger vanes then curve to form an angle with the central axis of approximately 45°, and the distal end portions of the vanes are generally parallel with the central axis of the sluice box.

Sluice box 10 also defines a first fine recovery channel 68 located along one side of coarse recovery channel 36, and a second fine recovery channel 70 located along the opposite side of coarse recovery channel 36. First and second fine reovery channels 68, 70 communicate with the distribution section 50, such that first fine recovery channel 68 is adjacent to the first floor portions of the distribution section, and the second fine recovery channel 70 is adjacent to the second floor portions of the distribution section. The first and second fine recovery channels are generally parallel to the coarse recovery channel, and all recovery channels are generally horizontal when sluice box 10 is horizontally disposed.

Fine recovery channels 68, 70 are defined by outer side walls 72, 74 of sluice box 10. The width of each of the first and second fine recovery channels is approximately six feet. As seen best in FIGS. 2 and 3, the depth of the fine recovery channels is approximately one-half the depth of the coarse recovery channels. The result is that the cross-sectional flow area of both fine recovery channels is approximately one and one-half times the cross-sectional flow area of the coarse recovery channel.

The structure located inside each fine recovery channel 68, 70 is identical, and each fine recovery channel includes a fine recovery section 76 and a superfine recovery section 78. The fine recovery section 76 includes a coco mat layer 80 located on a flat floor 82 of the fine recovery channel. A plurality of transverse, parallel fine riffles 84 are located on coco mat layer 80. Fine riffles 84 are formed of angle stock having one inch legs and the spacing between parallel riffles 84 is approximately one inch. Riffles 84 are disposed so that the upper legs are inclined slightly above horizontal as shown best in FIG. 3. Also, riffles 84 are retained in position by retaining bars 86 (see FIG. 1) so that the fine riffles may be lifted as a unit out of the fine recovery channel for cleaning purposes as discussed below.

Figure 5:
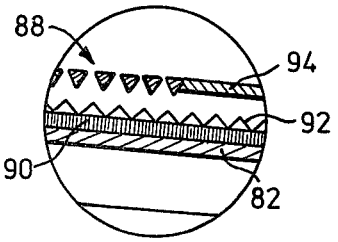
FIG. 5 is an enlarged vertical sectional view of a portion of FIG. 3 indicated by circle 5.

The superfine recovery section 78 includes a transverse ramp 86 which raises the moving fine slurry up onto a wedge-wire screen 88. As seen best in FIG. 5, the wedge-wire screen 88 is formed of a plurality of parallel triangular or wedge-like members which define openings or slots between the members approximately one millimeter in width. A bottom coco mat layer 90 is located on the flat floor 82 of the fine recovery channel, and an expanded metal riffle 92 is located on coco mat layer 90. Expanded metal riffle 92 is conventional expanded metal stock having one inch openings. A washover plate 94 is located above the expanded metal riffle 92 and adjacent to or downstream of the wedge-wire screen 88, to receive the coarser portion of the fine slurry that passes over the wedge-wire screen, as described further below.

Wire screens or grates 96 are placed over the top of the first and second fine recovery channels simply to permit an operator to walk thereon for easy access to the coarse recovery channel 36. Solid decks 98 are provided above distribution section 50 for the same purpose. However, viewing or access grates 100 are located in decks 98 for access to the distribution section floor therebelow.

In the operation or use of sluice box 10, the sluice box is placed in a desired location and is downwardly inclined from the inlet to the outlet, as shown in FIGS. 2 and 3. The slope or inclination of the sluice box is typically between one and three inches per foot, so the inlet end of the sluice box is raised above the outlet end approximately between three and eight feet. For average conditions, the inlet end would be raised about five or six feet. It will be appreciated that the greater the slope, the faster the slurry moves through the sluice box, and that generally, it is preferable to lower the flow rate as the size of the gold particles to be recovered decreases. In positioning the sluice box, it is usual to move earth around and behind the box to form a ramp to facilitate loading aggregate material into the box.

Once the sluice box is in position, water is supplied to the water manifold and aggregate material is dumped into the inlet trough at a generally steady rate. In practice, this is usually achieved using a bulldozer or other earth moving equipment. The term steady rate merely means that it is desirable not to allow the sluice box to operate for any appreciable length of time with just water flowing through the recovery channels. Otherwise, as described further below, the sand located between the riffles and which facilitates the trapping of the gold will wash out of the riffles. The aggregate material may be loaded into the inlet trough at a rate of approximately 400 cubic yards per hour, which is considered to be a high volume operation in placer mining.

It will be appreciated that the water being supplied by the water manifold is added to the aggregate material to mix and wash the material and form a slurry. Actually, this is a very heterogeneous slurry, and in fact may contain very large particles, such as boulders which could be up to three or four feet in diameter. In any event, this heterogeneous mixture or slurry flows down over the slick plate of the inlet trough and onto the punch plate. The finer particulate material (smaller than ⅜ inch in size) drops down through the punch plate along with approximately 25% of the water, where it forms a fine slurry in the distribution section. The remaining larger particles or coarse slurry passes over the punch plate and on into the coarse recovery channel 36. The fine slurry thus being separated is spread and evened in the distribution section by the conical downwardly and outwardly inclined floor portions 52, 54 and vanes 66. The conical floor portions tend to move the slurry outwardly from the centre of the sluice box, and the vanes direct the slurry downstream, resulting in a generally uniform cross-sectional flow profile for the fine slurry stream. Also, the flow rate of the fine slurry stream is slowed or decreased due to the reverse gradient of the downwardly inclined floor portions 52, 54 of the conical portion of the distribution section floor. In other words, the cross-sectional flow area increases as the slurry moves outwardly toward the sides of the sluice box causing a decrease in velocity. The flow rate of the slurry is then increased and the slurry is accelerated as it proceeds up first and second ramp portions 60, 62 prior to entering the fine recovery channels. The result of the action of the conical portion of the distribution section floor and the vanes is that the fine slurry streams have a generally uniform cross-sectional flow profile when they enter the fine recovery channels.

It will be appreciated that the amount of fine slurry that enters the distribution section will depend upon the composition of the aggregate material being fed into the sluice box. If the aggregate material comprises a higher percentage of fine particles (less than ⅜ inch), then more material will pass through the punch plate resulting in higher quantities of fine slurry. In general, the cross-sectional flow area of the combined fine recovery channels is about one and one-half times the cross-sectional flow area of the coarse recovery channel, so that if the volume of the fine slurry is less than one and one-half times that of the coarse slurry (typical), the flow rate of the fine slurry in the fine recovery channels will be less than the flow rate of the coarse slurry in the coarse recovery channel. In other words, the fine slurry is slowed in comparison with the coarse slurry to facilitate gold recovery in the fine recovery channels.

The following description of the action of the riffles and coco matting is applicable to both the coarse recovery channel and the fine recovery section of the fine recovery channel. In each case, as the slurry passes over the riffles, the slurry is agitated causing turbulent flow between the riffles. This turbulent flow causes sand to be suspended between the riffles in fluid motion, although a thin layer of sand is deposited on the coco matting. The turbulent fluid motion between the riffles tends to cause the gold particles to settle out and pass through the sand layer to be trapped in the coco matting below the riffles. The fine gold particles are trapped very quickly in the fine recovery section 76, and due to the uniform flow rate of the slurry over the fine riffles, the fine gold particles are not subsequently re-mobilized or washed out.

After the fine slurry passes over the riffles in the fine recovery channel, the fine slurry passes over the wedge-wire screen 88 where extremely fine particulate material and a portion of the water drops through the wedge-wire screen to form a superfine slurry stream. This superfine slurry stream is of lower velocity or flow rate than that of the entering fine slurry stream, because of the decreased volume. The now slower superfine slurry then passes over the expanded metal riffle where it is agitated in a manner similar to that caused by fine riffles 84, but on a much smaller scale, thus causing the extremely fine gold particles to settle out and be trapped in the coco matting located below the expanded metal riffle. The coarser portion of the fine slurry that does not pass through the wedge-wire screen 88 passes on over wash-over plate 94 and out the end of sluice box 10. The coarse and fine slurries thus emerging from the outlet end of the sluice box flow into a waste sump area and a silting pond where the water is drawn off and the remaining particulate material is stacked into tailings piles.

After the sluice box has been operated for a period of time, the process is stopped and the riffles are removed. The coco mat layers are then also removed and cleaned to obtain the trapped gold particles. The coco mats and riffles are then replaced and the sluice box is put into operation again. The frequency of cleanup depends upon the gold content of the aggregate material being sluiced. A higher gold content usually means more frequent cleanups. Typically, the fine recovery channels are cleaned about once per day and the coarse recovery channel is cleaned about once per week.

Having described a preferred embodiment of the invention, it will be appreciated that various modifications may be made to the apparatus and method described. For example, different types of riffles could be used if desired. Similarly, the sizes, spacing and angle of inclination of the riffles described could be changed. In general, the riffles should be dimensioned and spaced to produce sufficient turbulence to keep the fine particulate material therebetween in motion and produce a thin sand layer over the coco matting. The sand layer must be appropriately thick to permit the gold particles to pass through and be trapped in the coco matting, and yet prevent the gold from being re-mobilized by the turbulent flow between the riffles. These principles are considered to be well known to those skilled in the art and therefore will not be described in further detail.

It will be apparent that the recovery channels of the sluice box could be downwardly inclined rather than inclining the sluice box itself. Also, the fine recovery channels could be disposed on a different incline or slope than the coarse recovery channel. Further, the slopes of the fine and coarse recovery channels could be made independently adjustable. However, the structure described is preferred because of its simplicity and effectiveness.

The sluice box described above could be used for recovering other precious metals than gold, such as platinum. Other metals, such as tin, can also be recovered, and therefore the term precious metal used in this disclosure is intended to include all materials that may be recovered in this type of placer mining operation.

It will also be appreciated that the sluice box could be formed with only a single fine recovery channel with suitable modifications being made to the distribution section to produce the evening and spreading of the fine slurry as described above. In addition, the dimensions of the sluice box may be altered. For example, the fine recovery channels may be made four feet in width. In this case, the sluice box would typically handle 300 cubic yards per hour of aggregate material. Finally, the term aggregate material used in this disclosure is intended to include all material that is found in a typical placer mining cut, without any prior screening or the like, so that there is no decrease in the volume of production caused by initial culling operations.

The openings in the punch plates may be varied in size and spacing. Generally, the openings are made smaller or spaced further apart if it is desired to allow less water and fine aggregate material to pass therethrough to enter the fine recovery channels, and vice versa. It is preferable to maximize the amount of the fine aggregate material passing into the fine recovery channels, but it is not desirable to allow the size of the fine aggregate material particles entering the fine recovery channels to be so large that they interfere with the gold recovery action between the riffles. An opening size of $\frac{3}{8}$ or 7/16 inch has been found to be satisfactory for most situations.

It will be appreciated that the present invention provides a very simple method and apparatus for placer mining. In the invention, the gold particles are separated and trapped at a very early stage of the process and the slurry streams are controlled so that the trapped gold is not re-mobilized. and lost to reduce efficiency.

What I claim is:

1. Apparatus for use in high volume placer mining operations to separate and recover precious metals, such as gold, from aggregate material, the apparatus comprising:

a sluice box having an inlet trough and a coarse recovery channel leading therefrom and defining an outlet;

a water manifold adapted to be connected to a slurry of water under pressure for washing aggregate material in the inlet trough to form a slurry, said sluice box being adapted to be inclined so that the slurry passes through the sluice box from the inlet to the outlet;

the inlet trough having a punch plate bottom located adjacent to the coarse recovery channel, the punch plate bottom defining a plurality of openings for passing fine slurry therethrough and permitting coarse slurry to pass thereover into the coarse recovery channel;

a distribution section located below said punch plate bottom, said distribution section including a floor having first and second transversely and downwardly inclined portions, a ramp inclined upwardly and longitudinally of the sluice box axis, and a plurality of angularly disposed vanes, so that the fine slurry is evened and spread transversely of the sluice box axis;

a first fine recovery channel located along one side of the coarse recovery channel and a second fine recovery channel located along the opposite side of the coarse recovery channel, the first and second fine recovery channels communicating with said distribution section to receive said evened fine slurry; and the coarse and fine recovery channels having bottom coco mat layers, and respective coarse and fine riffles located thereon, so that as the coarse and fine slurries pass over the respective coarse and fine riffles, precious metal settles and is trapped in the coco mat.

2. Apparatus as claimed in claim 1 wherein the cross-sectional flow area of the first and second fine recovery channels is equal to the cross-sectional flow area of the coarse recovery channel.

3. Apparatus as claimed in claim 1 wherein the cross-sectional flow area of the first and second fine recovery channels is one and one-half times the cross-sectional flow area of the coarse recovery channel.

4. Apparatus as claimed in claim 1 and further including the fine recovery channel defining a superfine recovery section comprising: a transverse ramp inclined upwardly and longitudinally of the sluice box axis; a bottom coco mat layer; a wedge-wire screen spaced above the bottom coco mat layer; and an expanded metal riffle located on the coco mat layer.

5. Apparatus as claimed in claim 4 and further comprising a wash-over plate spaced above the expanded metal riffle downstream of the wedge-wire screen to receive slurry passing over the wedge-wire screen.

6. A method of separating and recovering precious metals from aggregate material in a high volume placer mining operation, the method comprising:

introducing aggregate material into a sluice box at a generally steady rate;

adding water to the aggregate to form a slurry for movement through the sluice box;

separating the slurry into a fine slurry stream and a coarse slurry stream;

spreading and evening the fine slurry stream so that it has a generally uniform cross-sectional flow profile;

slowing the fine slurry stream while spreading and evening said stream;

agitating the fine and coarse slurry stream by passing same over respective fine and coarse riffles; and trapping precious metal that settles out of the agitated fine and coarse slurry streams by providing coco matting below the riffles to retain the previous metal.

7. A method as claimed in claim 6 wherein the slurry is separated into fine and coarse slurry streams by passing the slurry over a punch plate defining a plurality of openings dimensioned so that the fine slurry stream has a maximum particle size of 154 inch.

8. A method as claimed in claim 6 wherein the fine slurry stream is accelerated after being slowed and while still being spread and evened.

9. A method as claimed in claim 6 and further comprising the steps after said agitation of the fine slurry stream of separating from the fine slurry stream a superfine slurry stream, agitating said superfine slurry stream by passing same over an expanded metal riffle, and trapping precious metal that settles out of the superfine slurry stream by providing coco matting below said expanded metal riffle to retain the precious metal.

10. A method as claimed in claim 9 and further comprising the step of slowing the flow rate of the separated superfine slurry stream while separating said superfine stream.

11. Apparatus for use in high volume placer mining operations to separate and recover precious metals, such as gold, from aggregate material, the apparatus comprising:

a sluice box having an inlet trough and a coarse recovery channel leading therefrom and defining an outlet;

a water manifold adapted to be connected to a supply of water under pressure for washing aggregate material in the inlet trough to form a slurry, said sluice box being adapted to be inclined so that the slurry passes through the sluice box from the inlet to the outlet;

the inlet trough having a punch plate bottom located adjacent to the coarse recovery channel, the punch plate bottom defining a plurality of openings for passing fine slurry therethrough and permitting coarse slurry to pass thereover into the coarse recovery channel;

a distribution section located below said punch plate bottom, said distribution section including a floor having a transversely and downwardly inclined portion, a ramp inclined upwardly and longitudinally of the sluice box axis, and a plurality of angularly disposed vanes, so that the fine slurry is evened and spread transversely of the sluice box axis;

a fine recovery channel located beside the coarse recovery channel and communicating with said distribution section to receive said evened fine slurry; and the coarse and fine recovery channels having bottom coco mat layers, and respective coarse and fine riffles located thereon, so that as the coarse and fine slurries pass over the respective coarse and fine riffles, previous metal settles and is trapped in the coco mat.

12. Apparatus for use in high volume placer mining operations to separate and recover precious metals, such as gold, from aggregate material, the apparatus comprising:

a sluice box having an inlet trough and a coarse recovery channel leading therefrom and defining an outlet;

a water manifold adapted to be connected to a supply of water under pressure for washing aggregate material in the inlet trough to form a slurry, said sluice box being adapted to be inclined so that the slurry passes through the sluice box from the inlet to the outlet;

the inlet trough having a punch plate bottom located adjacent to the coarse recovery channel, the punch plate bottom defining a plurality of openings for passing fine slurry therethrough and permitting coarse slurry to pass thereover into the coarse recovery channel;

a distribution section located below said punch plate bottom, said distribution section having a transversely and downwardly inclined floor portion, said floor portion also being upwardly inclined toward the coarse recovery channel thereby defining an upper ridge inclined upwardly and longitudinally of the sluice box axis, the distribution section further including a plurality of angularly disposed vanes, so that the fine slurry is evened and spread transversely of the sluice box axis;

a fine recovery channel located beside the coarse recovery channel and communicating with said distribution section to receive said evened fine slurry; and the coarse and fine recovery channels having bottom coco mat layers, and respective coarse and fine riffles located thereon, so that as the coarse and fine slurries pass over the respective coarse and fine riffles, precious metal settles and is trapped in the coco mat.

13. Apparatus as claimed in claim 12 wherein the distribution section floor includes a ramp inclined upwardly and longitudinally of the sluice box axis.

* * * * *